US010562152B2

(12) United States Patent
Beaudonnet et al.

(10) Patent No.: US 10,562,152 B2
(45) Date of Patent: Feb. 18, 2020

(54) METHOD FOR MODIFYING THE APPEARANCE OF A SURFACE

(71) Applicant: SAINT-GOBAIN CENTRE DE RECHERCHES ET D'ETUDES EUROPEEN, Courbevoie (FR)

(72) Inventors: Anne-Laure Beaudonnet, Robion (FR); Julien Cabrero, Salon de Provence (FR); Thomas Lambert, Althen des Paluds (FR)

(73) Assignee: SAINT-GOBAIN CETRE DE RECHERCHES ET D'ETUDES EUROPEEN, Courbevoie (FR)

( * ) Notice: Subject to any disclaimer, the term of this patent is extended or adjusted under 35 U.S.C. 154(b) by 110 days.

(21) Appl. No.: 15/570,443

(22) PCT Filed: Apr. 22, 2016

(86) PCT No.: PCT/EP2016/058999
§ 371 (c)(1),
(2) Date: Oct. 30, 2017

(87) PCT Pub. No.: WO2016/173938
PCT Pub. Date: Nov. 3, 2016

(65) Prior Publication Data

US 2018/0154500 A1 Jun. 7, 2018

(30) Foreign Application Priority Data

Apr. 30, 2015 (FR) ..... 15 53940

(51) Int. Cl.
*B24C 11/00* (2006.01)
*B24C 1/06* (2006.01)
*B24C 3/32* (2006.01)

(52) U.S. Cl.
CPC ..... *B24C 11/00* (2013.01); *B24C 1/06* (2013.01); *B24C 3/32* (2013.01)

(58) Field of Classification Search
CPC .... B24C 1/00; B24C 1/06; B24C 1/08; B24C 3/32; B24C 7/0007; B24C 7/0038; B24C 7/0046; B24C 7/0076; C09K 3/1409
See application file for complete search history.

(56) References Cited

U.S. PATENT DOCUMENTS 3,854,899 A 12/1974 Germain et al.
4,289,541 A * 9/1981 Wallner ..... B24C 1/00 134/36

(Continued)

FOREIGN PATENT DOCUMENTS

FR 2231476 A1 12/1974
TW 536455 B 6/2003
WO WO2010041223 A1 4/2010

OTHER PUBLICATIONS

Corresponding International application, application No. PCT/EP2016/058999, International Search Report dated Jul. 11, 2016, pages.

*Primary Examiner* — Timothy V Eley
(74) *Attorney, Agent, or Firm* — Cooper Legal Group, LLC; Ronald M. Kachmarik

(57) ABSTRACT

A process for modifying the appearance of a surface is provided. The process includes a stage of spraying particles exhibiting a maximum size of less than or equal to 500 μm. The sprayed particles exhibit a relative density of greater than 90%, more than 5% and less than 80% by volume of the sprayed particles being particles exhibiting a salient sharp edge. The salient sharp edge is referred to as "notching particles".

49 Claims, 2 Drawing Sheets

(56) References Cited

U.S. PATENT DOCUMENTS

| | | | | | |
|---|---|---|---|---|---|
| 4,947,591 | A * | 8/1990 | Risley | B24C 1/086 | 134/17 |
| 5,308,404 | A * | 5/1994 | Yam | B08B 7/02 | 134/6 |
| 5,607,480 | A * | 3/1997 | Beaty | A61C 8/0012 | 623/23.5 |
| 5,637,030 | A * | 6/1997 | Chopra | B24C 1/045 | 451/39 |
| 5,785,579 | A * | 7/1998 | Grondin | C03C 12/00 | 451/38 |
| 5,865,620 | A * | 2/1999 | Kutsch | A61C 3/025 | 433/88 |
| 5,964,644 | A * | 10/1999 | Rhoades | B24C 1/06 | 451/28 |
| 6,095,903 | A * | 8/2000 | Rien | B24C 1/003 | 451/28 |
| 8,758,461 | B2 * | 6/2014 | Yener | C09K 3/1409 | 51/293 |
| 9,321,147 | B2 * | 4/2016 | Cho | B21B 45/06 | |
| 2001/0023351 | A1 * | 9/2001 | Eilers | A61B 17/545 | 606/131 |
| 2003/0180537 | A1 * | 9/2003 | Meyer | B01D 39/06 | 428/404 |
| 2006/0219825 | A1 * | 10/2006 | Rohring | B02C 19/06 | 241/5 |
| 2009/0107629 | A1 * | 4/2009 | Oguri | B24C 1/06 | 156/279 |
| 2014/0186585 | A1 * | 7/2014 | Field, III | B24C 11/00 | 428/155 |

* cited by examiner

METHOD FOR MODIFYING THE APPEARANCE OF A SURFACE

TECHNICAL FIELD

The invention relates to a process for modifying the appearance of a surface, in particular a process for reducing the gloss of the said surface, in particular for an aesthetic or decorative purpose.

STATE OF THE ART

A treatment of a metal surface by spraying consists in spraying particles onto the surface, for example beads or grains, of metallic, ceramic or polymeric natures.

An example of treatment by spraying, referred to as "shot peening", serves to create surface prestresses in order to improve the mechanical properties and/or to increase the lifetime of the parts treated. The particles, with a size generally greater than 200 μm, preferably of greater than 300 μm, have to be hard and resistant and to be sprayed at high speed, preferably by means of a centrifugal blast wheel.

Another example of treatment by spraying, referred to as "cleaning" treatment, serves to strip and/or clean the surface. The particles, preferably abrasive grains (thus exhibiting sharp edges), with a size generally of between 100 μm and 500 μm, have to be sprayed at reduced speed.

Another example of treatment by spraying, referred to as "cosmetic finishing" treatment, serves to modify the appearance of the surface and in particular the colour, the texture and especially the form and topography (including the roughness), the gloss or the brightness. The particles, of a size generally less than 500 μm, preferably less than 300 μm, preferably less than 150 μm, preferably less than 100 μm, are generally abrasive grains or fused beads. They have to be sprayed at a speed lower than those employed to create surface prestresses. Suction blast machines, with pressures of less than 4 bar, preferably of less than 3 bar, are preferably used.

The particles employed and the spraying conditions are thus specific to each of the abovementioned treatments. The problems posed for a specific treatment, for example for shot peening, and the solutions provided in order to solve them are thus not, a priori, extrapolatable to another treatment, for example to a cosmetic finishing treatment.

Generally, a cosmetic finishing treatment using ceramic beads results in glossy renderings and may generate a deformation of the said surface.

There thus exists a need for a process which makes it possible to modify, indeed even adjust, the gloss of a surface without necessarily modifying the parameters of spraying (pressure, spraying distance and spraying angle in particular). In particular, there exists a need for a process which makes it possible to reduce the gloss, without risk of deformation of the surface and without accelerating the wear of the spraying devices.

An aim of the invention is to respond, at least partially, to this need.

SUMMARY OF THE INVENTION

According to the invention, this aim is achieved by means of a process for modifying the appearance of a surface, comprising a stage of spraying particles exhibiting a maximum size of less than or equal to 500 μm, the particles exhibiting a relative density of greater than 90%, more than 5% and less than 80% by volume of the said particles, referred to as "sprayed particles", being notching particles, the other sprayed particles being known as "non-notching particles".

The inventors have found that such a process advantageously makes it possible to respond to the abovementioned need. In particular, without being able to theoretically explain it, the inventors have found that the process makes it possible to reduce the gloss of the treated surface without additional deformation of the surface.

Preferably, a process according to the invention also exhibits one or more of the following optional characteristics:

- the group of the sprayed particles exhibits a maximum size of less than 400 μm, preferably of less than 300 μm, preferably of less than 200 μm, preferably of less than 150 μm, indeed even of less than 120 μm;
- the group of the sprayed particles exhibits a minimum size of greater than 5 μm, preferably of greater than 10 μm, preferably of greater than 15 μm, preferably of greater than 20 μm, indeed even of greater than 30 μm, indeed even of greater than 40 μm;
- the group of the sprayed particles exhibits a minimum size of greater than 15 μm and a maximum size of less than 60 μm, or the group of the sprayed particles exhibits a minimum size of greater than 40 μm and a maximum size of less than 90 μm, or the group of the sprayed particles exhibits a minimum size of greater than 55 μm and a maximum size of less than 120 μm;
- the group of the sprayed particles exhibits a median size of less than 100 μm, preferably of less than 90 μm, preferably of less than 80 μm, and/or of greater than 30 μm;
- the group of the sprayed particles comprises more than 10%, preferably more than 20%, preferably more than 30%, and/or preferably less than 70%, preferably less than 60%, by volume, of notching particles;
- the mean dimension of the notching particles is greater than 15 μm, preferably greater than 20 μm, preferably greater than 30 μm, preferably greater than 40 μm, and/or preferably less than 300 μm, preferably less than 200 μm, preferably less than 150 μm, preferably less than 120 μm;
- the mean dimension of the non-notching particles is greater than 15 μm, preferably greater than 20 μm, preferably greater than 30 μm, preferably greater than 40 μm, and/or preferably less than 300 μm, preferably less than 200 μm, preferably less than 150 μm, preferably less than 120 μm;
- the ratio of the mean dimension of the notching particles to the mean dimension of the non-notching particles is greater than 1/20, preferably greater than 1/15, preferably greater than 1/10, preferably greater than 1/5, preferably greater than 1/3, and/or less than 20, preferably less than 15, preferably less than 10, preferably less than 5, preferably less than 3, preferably less than 2.5, preferably less than 2, preferably less than 1.5;
- the ratio of the median size of the group of the notching particles to the median size of the group of the non-notching particles is greater than 1/20, preferably greater than 1/15, preferably greater than 1/10, preferably greater than 1/5, preferably greater than 1/3, and/or less than 20, preferably less than 15, preferably less than 10, preferably less than 5, preferably less than 3, preferably less than 2.5, preferably less than 2, preferably less than 1.5;
- the group of the notching particles exhibits a mean circularity squared of less than 0.9, preferably of less than 0.85, and/or of greater than 0.5, preferably of greater than 0.6, preferably of greater than 0.65, preferably of greater than 0.7, preferably of greater than 0.75;

the group of the non-notching particles exhibits a mean circularity squared of greater than 0.7, preferably of greater than 0.8, preferably of greater than 0.85, indeed even of greater than 0.90, indeed even of greater than 0.92, indeed even of greater than 0.94, indeed even of greater than 0.95, indeed even of greater than 0.96;

more than 80%, more than 90%, more than 95%, indeed even substantially 100%, of the notching particles are faceted particles;

the mean number of facets of the faceted particles is greater than 3, preferably greater than 4 and less than 30, preferably less than 25, preferably less than 20, preferably less than 15, preferably less than 10;

the sprayed particles exhibit a relative density of greater than 92%, preferably of greater than 94%, preferably of greater than 95%, preferably of greater than 96%, indeed even of greater than 97%, indeed even of greater than 98%;

the bulk density of the sprayed particles is preferably greater than 2.5 g/cm$^3$, preferably greater than 3.0 g/cm$^3$, preferably greater than 3.3 g/cm$^3$, preferably greater than 3.6 g/cm$^3$;

in one embodiment, the ratio of the density of the group of the notching particles to the density of the group of the non-notching sprayed particles is between 0.8 and 1.2, preferably between 0.9 and 1.1;

in one embodiment, the ratio of the density of the group of the notching particles to the density of the group of the non-notching particles is less than 0.8, preferably less than 0.6 or greater than 1.2, preferably greater than 1.4;

the total area of the notching particles, measured on photographs and expressed as percentage of the total area of the group of the sprayed particles, is greater than 5%, preferably greater than 10%, preferably greater than 20%, preferably greater than 25%, preferably greater than 30%, and/or less than 90%, preferably less than 80%, preferably less than 75%, preferably less than 70%, preferably less than 60%;

the sprayed particles are preferably made of a ceramic material, preferably chosen from oxides, nitrides, carbides, borides, oxycarbides, oxynitrides and their mixtures;

the sprayed particles are preferably composed of oxides for more than 50%, preferably for more than 70%, preferably for more than 90%, preferably for more than 95%, indeed even for more than 99%, of their weight;

in one embodiment, the group of the notching particles and the group of the non-notching particles exhibit substantially the same chemical analysis;

in one embodiment, the group of the notching particles and the group of the non-notching particles exhibit a different chemical analysis;

in one embodiment, the group of the sprayed particles and/or the group of the notching particles and/or the group of the non-notching particles exhibit a content of $Al_2O_3+ZrO_2+SiO_2>80\%$, preferably >85%, preferably >90%, preferably with $SiO_2<20\%$, indeed even $SiO_2<10\%$, as percentage by weight on the basis of the oxides;

in one embodiment, the group of the sprayed particles and/or the group of the notching particles and/or the group of the non-notching particles exhibit the following chemical composition, as percentage by weight on the basis of the oxides:

$70\% \leq Al_2O_3$, $Al_2O_3$ constituting the remainder to 100%, $3\% \leq ZrO_2+HfO_2 \leq 20\%$, with $HfO_2 \leq 1\%$, $1\% \leq SiO_2 \leq 10\%$, $0.3\% \leq CaO+MgO \leq 5\%$, other constituents <5%;

in one embodiment, the group of the sprayed particles and/or the group of the is notching particles and/or the group of the non-notching particles exhibit the following chemical composition, as percentage by weight on the basis of the oxides:

$Al_2O_3 \leq 10\%$, $60\% \leq ZrO_2+HfO_2 \leq 70\%$, with $HfO_2 \leq 1\%$, $25\% \leq SiO_2 \leq 35\%$, other constituents <5%;

in one embodiment, the group of the sprayed particles and/or the group of the notching particles and/or the group of the non-notching particles exhibit the following chemical composition, as percentage by weight on the basis of the oxides:

$Al_2O_3 \leq 10\%$, $65\% \leq ZrO_2+HfO_2 \leq 80\%$, with $HfO_2 \leq 1.5\%$, $10\% \leq SiO_2 \leq 20\%$, 4% $Y_2O_3 \leq 8\%$, other constituents <3%;

in one embodiment, the group of the sprayed particles and/or the group of the notching particles and/or the group of the non-notching particles exhibit the following chemical composition, as percentage by weight on the basis of the oxides:

$90\% \leq Al_2O_3$, preferably $95\% \leq Al_2O_3$, other constituents <10%;

in one embodiment, the group of the sprayed particles and/or the group of the notching particles and/or the group of the non-notching particles are composed, for more than 80%, preferably for more than 90%, of their weight, of zirconia which is at least partially stabilized, preferably at least partially stabilized with yttrium oxide;

in one embodiment, the group of the sprayed particles and/or the group of the notching particles and/or the group of the non-notching particles are composed, for more than 80%, preferably for more than 90%, preferably for more than 95%, of their weight, of silicon carbide;

in one embodiment, the group of the sprayed particles and/or the group of the notching particles and/or the group of the non-notching particles exhibit the following chemical composition, as percentage by weight on the basis of the oxides:

$70\% \leq Al_2O_3 \leq 80\%$, $20\% \leq ZrO_2+HfO_2 \leq 30\%$, with $HfO_2 \leq 1\%$, other constituents ≤3%, preferably ≤1%;

in one embodiment, the sprayed particles are sintered particles;

in one embodiment, the sprayed particles are fused particles, that is to say obtained by melting-solidification;

in one embodiment, the group of the sprayed particles is a mixture of sintered particles and fused particles;

in one embodiment, the group of the sprayed particles exhibits a maximum size of less than 300 μm, preferably of less than 200 μm, preferably of less than 150 μm, and comprises more than 10%, preferably more than 20%, preferably more than 30%, and/or preferably less than 70%, preferably less than 60%, by volume, of notching particles, and the mean dimension of the notching particles is greater than 15 μm, preferably greater than 20 μm, preferably greater than 30 μm, preferably greater than 40 μm, and less than 300 μm, preferably less than 200 μm, preferably less than 150 μm, preferably less than 120 μm, and the mean dimension of the non-notching particles is greater than 15 μm, preferably greater than 20 μm, preferably greater than 30 μm, preferably greater than 40 μm, and less than 300 μm, preferably less than 200 μm, preferably less than 150 μm, preferably less than 120 μm, and the ratio of the mean dimension of the notching particles to the mean dimension of the non-notching particles is greater than 1/20, preferably greater than 1/15, preferably greater than 1/10, preferably greater than 1/5, preferably greater than 1/3, and/or less than 20, preferably less than 15, preferably less than 10, preferably less than 5, preferably less than 3, preferably less than 2.5, preferably less than 2, preferably less than 1.5;

in one embodiment, the group of the sprayed particles exhibits a maximum size of less than 300 μm, preferably of less than 200 μm, preferably of less than 150 μm, and comprises more than 10%, preferably more than 20%, preferably more than 30%, and/or preferably less than 70%, preferably less than 60%, by volume, of notching particles, and the mean dimension of the notching particles is greater than 15 μm, preferably greater than 20 μm, preferably greater than 30 μm, preferably is greater than 40 μm, and less than 300 μm, preferably less than 200 μm, preferably less than 150 μm, preferably less than 120 μm, and the mean dimension of the non-notching particles is greater than 15 μm, preferably greater than 20 μm, preferably greater than 30 μm, preferably greater than 40 μm, and less than 300 μm, preferably less than 200 μm, preferably less than 150 μm, preferably less than 120 μm, and the ratio of the mean dimension of the notching particles to the mean dimension of the non-notching particles is greater than 1/20, preferably greater than 1/15, preferably greater than 1/10, preferably greater than 1/5, preferably greater than 1/3, and/or less than 20, preferably less than 15, preferably less than 10, preferably less than 5, preferably less than 3, preferably less than 2.5, preferably less than 2, preferably less than 1.5, and the group of the notching particles exhibits a mean circularity squared of less than 0.9, preferably of less than 0.85, preferably of less than 0.8, and/or of greater than 0.5, preferably of greater than 0.6, preferably of greater than 0.65, preferably of greater than 0.7, and the group of the non-notching particles exhibits a mean circularity squared of greater than 0.7, preferably of greater than 0.8, preferably of greater than 0.85, indeed even of greater than 0.90, indeed even of greater than 0.92, indeed even of greater than 0.94, indeed even of greater than 0.95, indeed even of greater than 0.96, indeed even of greater than 0.97;

in one embodiment, the group of the sprayed particles exhibits a maximum size of less than 300 μm, preferably of less than 200 μm, preferably of less than 150 μm, and comprises more than 10%, preferably more than 20%, preferably more than 30%, and/or preferably less than 70%, preferably less than 60%, by volume, of notching particles, and the mean dimension of the notching particles is greater than 15 μm, preferably greater than 20 μm, preferably greater than 30 μm, preferably greater than 40 μm, and less than 300 μm, preferably less than 200 μm, preferably less than 150 μm, preferably less than 120 μm, and the mean dimension of the non-notching particles is greater than 15 μm, preferably greater than 20 μm, preferably greater than 30 μm, preferably greater than 40 μm, and less than 300 μm, preferably less than 200 μm, preferably less than 150 μm, preferably less than 120 μm, and the ratio of the mean dimension of the notching particles to the mean dimension of the non-notching particles is greater than 1/20, preferably greater than 1/15, preferably greater than 1/10, preferably greater than 1/5, preferably greater than 1/3, and/or less than 20, preferably less than 15, preferably less than 10, preferably less than 5, preferably less than 3, preferably less than 2.5, preferably less than 2, preferably less than 1.5, and the group of the notching particles exhibits a mean circularity squared of less than 0.9, preferably of less than 0.85, preferably of less than 0.8, and/or of greater than 0.5, preferably of greater than 0.6, preferably of greater than 0.65, preferably of greater than 0.7, and the group of the non-notching particles exhibits a mean circularity squared of greater than 0.7, preferably of greater than 0.8, preferably of greater than 0.85, indeed even of greater than 0.90, indeed even of greater than 0.92, indeed even of greater than 0.94, indeed even of greater than 0.95, indeed even of greater than 0.96, indeed even of greater than 0.97, and the group of the sprayed particles and/or the group of the notching particles and/or the group of the non-notching particles exhibit a content of $Al_2O_3+ZrO_2+SiO_2>80\%$, preferably >85%, preferably >90%, preferably with $SiO_2<20\%$, indeed even $SiO_2<10\%$, as percentage by weight on the basis of the oxides;

the process comprises the following stages, preceding the spraying of the sprayed particles onto the surface to be treated:

a) preparation of a powder formed of notching particles and of a powder formed of non-notching particles, b) optionally mixing the powder formed of notching particles and the powder formed of non-notching particles, the particles are sprayed along a direction forming a spraying angle with the surface; the spraying angle, that is to say the angle between the surface to be treated and the said direction (the axis of the jet of the sprayed particles), is preferably greater than 45°, preferably greater than 50°;

the particles are sprayed by passing through a nozzle situated at a distance, referred to as "spraying distance", from the treated surface, the said spraying distance is preferably being greater than 5 cm, preferably greater than 10 cm, and/or preferably less than 30 cm, preferably less than 25 cm;

the particles are sprayed onto the surface by being carried by a fluid, preferably air, the pressure of which is preferably greater than 0.5 bar, preferably greater than 1 bar, and/or preferably less than 4 bar, preferably less than 3 bar;

the particles are sprayed with a degree of coverage preferably of greater than 100%, preferably of greater than 120%, indeed even of greater than 150%, and/or preferably of less than 300%, preferably of less than 250%, preferably of less than 200%;

the treated surface is made of a metal material, preferably in the form of a metal or of a metal alloy, preferably made of stainless steel, of aluminium or of titanium, preferably devoid of a coating and in particular of paint;

the notching particles are mixed with the other particles before being sprayed;

the surface is a surface of a product chosen from the set formed by a jewel, a watch, a bracelet, a necklace, a ring, a broach, a tiepin, a handbag, a piece of furniture, a household utensil, a handle, a button, a veneer, a visible part of a consumer goods device, a part of a spectacle frame, a piece of crockery or a frame.

Another subject-matter according to the invention consists of a product comprising a surface obtained by a process according to the invention. Preferably, the said surface is exposed to the exterior.

Preferably, the product according to the invention is chosen from the set formed by a jewel, a watch, a bracelet, a necklace, a ring, a broach, a tiepin, a handbag, a piece of furniture, a household utensil, a handle, a button, a veneer, a visible part of a consumer goods device, a part of a spectacle frame, a piece of crockery or a frame.

Definitions

A "notching" particle is a particle exhibiting a salient sharp edge so that, when it is sprayed following a process according to the invention, the said sharp edge creates a notch, that is to say a recess exhibiting a reentrant edge, for example in the form of a slit or "corner". By definition, a salient edge belongs to a convex part of the particle. On the other hand, the corresponding reentrant edge belongs to a concave part of the treated surface.

A "faceted particle", such as the particle 20' represented in FIG. 2, is a preferred example of notching particle. A faceted particle exhibits at least two facets and more than 90% of its surface is covered with facets, which are preferably substantially flat, preferably with less than 35 facets, which are preferably substantially flat, a facet being a surface delimited by a sharp edge. A facet may or may not be flat. A "nut" shape is an example of a shape having two facets.

A faceted particle may in particular be "polyhedral", that is to say be limited from all sides by flat polygons. A faceted particle may in particular be "regular" polyhedral if all its faces are regular polygons of the same type and if all its vertices are of the same degree. A regular polyhedron has a sphere tangent to each face at its centre. A "cube" is an example of a regular polyhedron comprising 6 square faces.

The "mean number of facets of the faceted particles" is the arithmetic mean of the mean number of facets of the faceted particles, the facets counted being the facets observable on a photograph representing the said faceted particles, for example on a photograph taken with a scanning electron microscope, such as FIG. 2.

A "non-notching" particle, such as the particle 10' represented in FIG. 2, is a particle which is not "notching", that is to say which exhibits only a smooth surface, such as a bead.

The volume of the notching particles is equal to the ratio of the weight of the said notching particles to the bulk density of the said notching particles. The percentage of this volume is measured with respect to the volume of the group of the sprayed particles.

The "coverage" is the ratio of the impacted surface area, that is to say the surface area modified by the impact of the sprayed particles, to the total surface area towards which the particles are sprayed. It is expressed as percentages.

The degree of coverage, expressed as percentages, is the ratio of the treatment time to the treatment time which makes it possible to obtain a coverage equal to 98%. Thus, a degree of coverage equal to 200% expresses the fact that the duration of the treatment is equal to twice that necessary in order to achieve a coverage of greater than or equal to 98%.

In order to evaluate the "circularity squared" "$Ci^2$" of a particle P, the perimeter $P_D$ of the disc D exhibiting an area equal to the area $A_p$ of the particle P is determined on a photograph of this particle. Furthermore, the perimeter $P_r$ of this particle is determined. The circularity is equal to the $P_D/P_r$ ratio. The circularity squared is thus equal to $(P_D/P_r)^2$, i.e.

$$Ci^2 = \frac{4 * \pi * A_p}{(P_r)^2}.$$

The more elongated in shape the particle, the lower the circularity squared. All the measurement methods known for evaluating the circularity squared may be envisaged and in particular starting from photographs obtained using a scanning electron microscope, it being possible for the said circularity squared to be subsequently determined using image processing software.

The lightness "L" expresses the intensity of the colour of the surface. For a crude metal surface, L corresponds to a level of grey, in particular when the surface is made of a material based on aluminium metal.

The lightness L of the surface may be measured according to Standard ASTM E308-01, "Standard practice for computing the colors of objects by using the CIE system".

The characteristic L is a characteristic of the well known Lab system.

The colour values and in particular the value of the lightness (L) may be measured by virtue of a MiniScan XE Plus having the HunterLab brand name.

"Darkening" of a surface refers to a decrease of at least 5% in the value of the lightness L of the said surface.

The decrease in the lightness is equal to (initial lightness–final lightness)/initial lightness, expressed as percentages.

The gloss G expresses the diffuse or specular reflection of the light. Unless otherwise indicated, the gloss is measured with an angle equal to 60°.

"Decrease" in the gloss of a surface refers to a decrease of at least 5% in the value of the gloss G of the said surface.

The decrease in the gloss is equal to (initial gloss−final gloss)/initial gloss, expressed as percentages.

"Almon intensity" is understood to mean, in accordance with Standard NF L06-832, the value of the deflection (that is to say, of the arc height) obtained at the time $t_s$ on the saturation curve, the saturation curve being obtained by measuring the variation in the Almen deflection as a function of the time of exposure to unvarying peening parameters and conditions, the saturation time $t_s$ being the first time t such that, at the time 2t, the variation in the deflection is less than or equal to 10% of the deflection at the time t, while making sure that the coverage is complete and uniform over the entire surface of the Almen test specimen. It is expressed in hundredths of a millimetre.

"Size of a particle" is understood to mean the size of a particle given conventionally by a particle size distribution characterization carried out with a laser particle sizer. The laser particle sizer used may be a Partica LA-950 from Horiba.

"Median size" of a group of particles, denoted $D_{50}$, refers to the size dividing the particles of this group into a first population and a second population equal in volume, this first population and this second population comprising only particles respectively exhibiting a size greater than or equal to, or less than, the said median size.

"Maximum size" of a group of particles, denoted $D_{99.5}$, refers to the particle size corresponding to the percentage equal to 99.5%, by volume, on the cumulative particle size distribution curve of the group of the particles, the said particle sizes being categorized by increasing order. According to this definition, 99.5% by volume of the particles thus have a size of less than $D_{99.5}$ and 0.5% of the particles, by volume, have a size of greater than or equal to $D_{99.5}$.

"Minimum size" of a group of particles, denoted $D_{0.5}$, refers to the particle size corresponding to the percentage equal to 0.5%, by volume, on the cumulative particle size distribution curve of the group of particles, the said particle sizes being categorized by increasing order.

The median size, the minimum size and the maximum size may be measured by laser particle sizing.

"Ceramic material" conventionally refers to a material which is neither metallic nor organic.

"Dimension of a particle" refers to the diameter corresponding to the circle exhibiting the same area as the said particle, measured on a photograph obtained using a scanning electron microscope. This dimension may be determined using image processing software. The "mean dimension" of a group of particles is the arithmetic mean of the dimensions of the said particles.

"Bulk density of a particle" is conventionally understood to mean the ratio equal to the weight of the particle divided by the apparent volume which it occupies. For convenience, the bulk density is measured on a group of particles. It may be measured by impregnation, according to the buoyancy principle.

"Absolute density of a particle" is understood to mean the ratio equal to the weight of dry matter of the particle after grinding to a fineness such that substantially no closed porosity remains, divided by the volume of the said weight of dry matter after grinding. It is may be measured by helium pycnometry.

The "relative density of a particle" corresponds to the ratio equal to the bulk density of the said particle divided by the absolute density of the said particle, expressed as percentage.

"Comprising a" or "exhibiting a" is understood to mean "comprising at least one", unless otherwise indicated.

BRIEF DESCRIPTION OF THE FIGURES

Other characteristics and advantages of the invention will become more apparent on reading the detailed description which will follow and on examining the appended drawing, in which.

Figure 1:
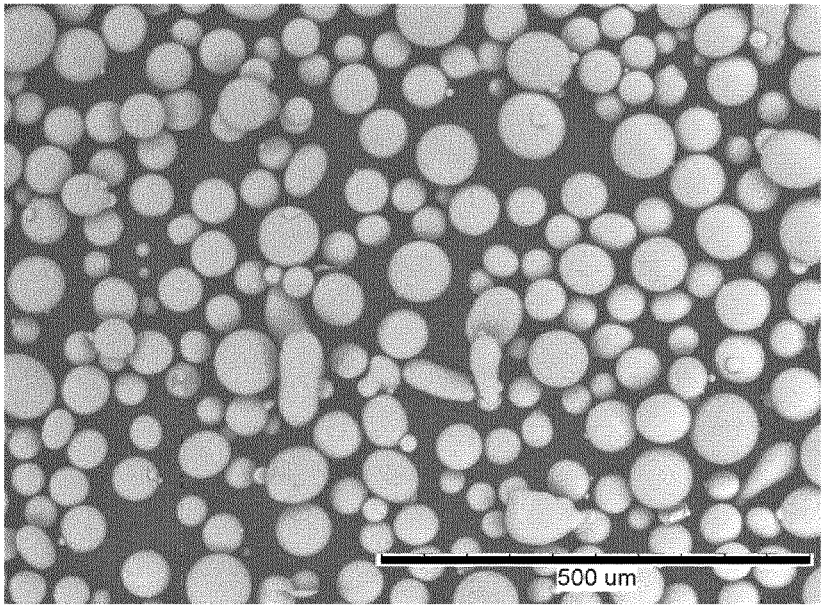
FIGS. 1 and 2 represent photographs of the sprayed particles (a) used in the process of Comparative Example 1 and of the sprayed particles (c) used in the process of Example 3 according to the invention, respectively.
Figure 2:
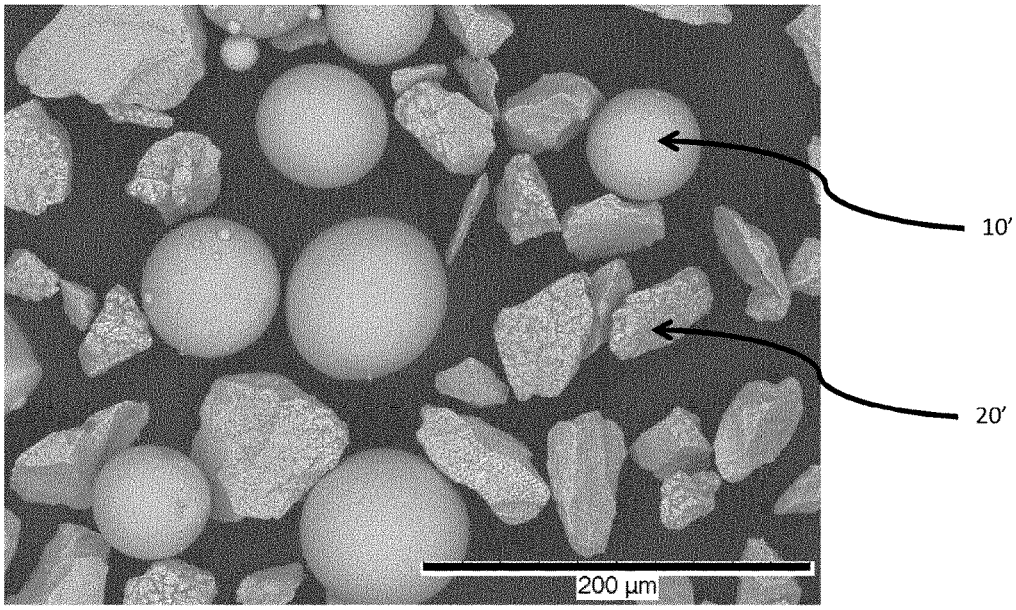

In the figures, identical references are used to denote identical or analogous elements.

DETAILED DESCRIPTION

The known techniques for cosmetic finishing treatment by spraying may be employed, using particles as described above.

The surface to be treated may be subjected, before treatment by spraying, to a pretreatment, for example a polishing, so that the surface to be treated exhibits a roughness Ra of less than or equal to 1 μm, preferably less than or equal to 0.8 μm, preferably less than or equal to 0.5 μm, preferably less than or equal to 0.3 μm, preferably less than or equal to 0.2 μm. The polishing can, for example, be of mirror type.

In one embodiment, the surface onto which the particles are sprayed does not comprise a coating. In one embodiment, only particles exhibiting a maximum size of less than or equal to 500 μm and a relative density of greater than 90% are sprayed in order to modify the appearance of the surface to be treated, more than 5% and less than 80% by volume of the said sprayed particles being notching particles.

Preferably again, throughout the treatment of the surface to be treated, the amount by volume of notching particles in the group of the sprayed particles is substantially constant, whatever the moment considered. Preferably, the variation in the amount by volume of notching particles in the group of the sprayed particles, measured between the beginning and the end of the treatment, is less than 20%, preferably less than 10%, preferably less than 5%, on the basis of the said amount at the beginning of the treatment.

Preferably, the sharp edges of the notching particles employed in a process according to the invention are capable of resulting from breakages of particles of larger origin. In one embodiment, they result from such breakages. In particular, the notching particles may be obtained by grinding larger particles, for example beads, for example by grinding using a roll mill.

Preferably, the notching particles exhibit at least one substantially flat face.

Preferably, the substantially flat surfaces cover more than 70%, more than 80%, more than 90%, indeed even substantially 100%, of the surface of the notching particles.

The non-notching particles may be prepared by any technique known to a person skilled in the art which makes it possible to obtain non-notching particles, in particular beads, for example by atomization, by lapping, by granulation or by a process of gelling droplets of a suspension.

In one embodiment, the group of the notching particles and the group of the non-notching particles exhibit substantially the same chemical analysis. Preferably, if the content of a constituent in a first group is greater than 10%, it preferably differs by less than 6%, preferably by less than 5%, preferably by less than 3%, as absolute percentage, from the corresponding content in the second said group. Preferably, if the content of a constituent in a first group is greater than 0.5% and less than or equal to 10%, it preferably differs by less than 40%, preferably by less than 30%, preferably by less than 20%, from the corresponding content in the second said group.

In a preferred embodiment, the process comprises the following stages, preceding the spraying of the particles onto the surface to be treated:

a) preparation of a powder formed of notching particles and of a powder formed of non-notching particles,
b) mixing the powder formed of notching particles and the powder formed of non-notching particles.

In stage a), the powder formed of notching particles may be prepared by any technique known to a person skilled in the art which makes it possible to obtain notching particles, for example by grinding, preferably using a roll mill. In stage b), the mixing of the powder formed of notching particles and of the powder formed of non-notching particles may be carried out according to any technique known to a person skilled in the art, for example using a mixer.

Notching particles and non-notching particles are preferably mixed in an amount such that the volume of the notching particles represents more than 5%, preferably more than 10%, preferably more than 20%, preferably more than 30%, and less than 80%, preferably less than 70%, more preferably less than 60%, of the volume of the mixture.

For the implementation of the invention, a compressed air blasting machine, preferably a pressurized blasting machine and preferably a Venturi-effect blasting machine is preferably used.

The spray nozzle of the blasting machine preferably exhibits a diameter of greater than 6 mm, preferably greater than 7 mm, and/or of less than 10 mm, preferably less than 9 mm, preferably of approximately 8 mm.

A process according to the invention makes it possible to maintain, indeed even to reduce, the Almen intensity, that is to say the energy deposited on the surface treated. Advantageously, this result makes it possible to limit the risks of deformation of the surface.

A process according to the invention may in particular be carried out in order to reduce the gloss of a surface. To this end, from a first test, it is possible:

to increase the volume of notching particles, and/or
to increase the number of sharp edges, in particular of facets, of the notching particles, and/or
to reduce the size of the sprayed particles, and/or
to reduce the dimension of the notching particles.

The gloss of a metal surface, in particular made of aluminium, may be thus reduced by more than 10%, indeed even by more than 30%, indeed even by more than 70%, without increasing the Almen intensity of the said surface, indeed even while reducing it.

If after a first test, the gloss obtained is too low, in order to obtain a surface exhibiting a greater gloss starting from the same original surface, it is possible:

to reduce the volume of notching particles, and/or
to reduce the number of sharp edges, in particular of facets, of the notching particles, and/or
to increase the size of the sprayed particles, and/or
to increase the dimension of the notching particles.

A process according to the invention may in particular be carried out in order to reduce the lightness L of a surface. To this end, starting from a first test, it is possible:

to increase the volume of notching particles, and/or
to reduce the size of the sprayed particles, and/or
to decrease the dimension of the notching particles.

The lightness L of a metal surface, in particular made of aluminium, may be thus reduced by more than 10%, indeed even by more than 20%, indeed even by more than 30%.

If, after a first test, the lightness L obtained is too low, in order to obtain a surface exhibiting a greater lightness L starting from the same original surface, it is possible:

to reduce the volume of notching particles, and/or
to increase the size of the sprayed particles, and/or
to increase the dimension of the notching particles.

The surface obtained, preferably exhibiting an area of greater than 1 $mm^2$, than 1 $cm^2$, than 10 $cm^2$, is covered, for more than 80%, preferably for more than 90%, preferably for 100%, with cavities, more than 90% by number of the said cavities exhibiting a size of less than 300 μm and being a mixture of cavities existing in the form of scales and of cavities existing in the form of notches. The cavities existing in the form of a notch are mainly created by the impact of the notching particles sprayed onto the surface, whereas the cavities existing in the form of scales are mainly created by the impact of the non-notching particles.

The following nonlimiting examples are given with the aim of illustrating the invention.

The following particles were tested:

Group of particles (a) of Comparative Example 1: Powder formed of Microblast® B170 beads sold by Saint-Gobain Zirpro exhibiting the following characteristics:
- chemical analysis: $Al_2O_3$: 6%, $ZrO_2$: 63%, $SiO_2$: 30%, others: 1%,
- particles obtained by melting-solidification,
- passing through the square-meshed sieve with an opening equal to 90 μm and not passing through the square-meshed sieve with an opening equal to 45 μm,
- median size: 74 μm,
- relative density of the particles, measured on the group of the said particles: 98%,
- bulk density of the particles, measured on the group of the said particles: 3.90 $g/cm^3$,
- mean circularity squared of the group of the particles: 0.97,
- amount of notching particles: <1% by volume.

Powder formed of notching particles used in the groups of particles (b) to (d), and (f), of Examples 2 to 4, and 6, respectively: Powder formed of Zirgrit® F grains sold by Saint-Gobain Zirpro exhibiting the following characteristics:
- chemical analysis: $Al_2O_3$: 6%, $ZrO_2$: 63%, $SiO_2$: 30%, others: 1%,
- particles obtained by melting-solidification, then grinding,
- median size: 50 μm,
- relative density of the particles, easured on the group of the said particles: 98%,
- bulk density of the particles, measured on the group of the said particles: 3.90 $g/cm^3$,
- mean circularity squared of the group of the particles: 0.83, amount of notching particles: >99% by volume.

Powder formed of notching particles used in the group of particles (e) of Example 5: a powder formed of Sika® ABR F150 silicon carbide grains sold by Saint-Gobain, sieved so as to recover the part passing through the square-meshed sieve with openings equal to 125 μm and not passing through the square-meshed sieve with an opening equal to 45 μm, and exhibiting, after sieving, the following characteristics:

chemical analysis: SiC>99% by weight, median size: 72 μm, relative density of the particles, measured on the group of the said particles: 99%, bulk density of the particles, measured on the group of the said particles: 3.19 g/cm$^3$, mean circularity squared of the group of the particles: 0.75, amount of notching particles >99% by volume.

Powder formed of notching particles (g) used in Example 7: powder formed of abrasive alumina/zirconia grains, exhibiting the following characteristics:

chemical analysis by weight: $Al_2O_3$: 57%, $ZrO_2$: 40%, $SiO_2$: 0.44%, $Y_2O_3$: 0.45%, $TiO_2$: 1.61%, others: 0.5%, particles obtained by melting-solidification, then grinding, median size: 106 μm, relative density of the particles, measured on the group of the said particles: 99%, bulk density of the particles, measured on the group of the said particles: 4.6 g/cm$^3$, amount of notching particles >99% by volume.

The notching particles were subsequently mixed, in the proportions by volume shown in Table 1, with the particles (a) of Comparative Example 1 in order to obtain the groups of particles (b) to (f) of Examples 2 to 6 respectively according to the invention.

The characteristics of the groups of particles (a) to (f) of Examples 1 to 6 respectively appear in Table 1.

The groups of particles (a) to (f) were subsequently used to treat the surface of a plate made of 6063 aluminium, exhibiting, before treatment, the following characteristics:

a lightness L equal to 70, a gloss G equal to 100.

The said treatment was carried out using a DUP suction blast machine with the following parameters:

diameter of the nozzle: 8 mm, pressure: 2 bar, spraying distance: 15 cm, spraying angle: 85°, degree of coverage: 100%.

Example 7 consists of a first spraying of a powder formed of particles (a) of Comparative Example 1, followed by a second spraying of a powder formed of notching particles (g), the characteristics of which appear in Table 1. The sprayings are thus sequential.

The treated surface exhibited, before the first spraying, the following characteristics:

a lightness L equal to 70, a gloss G equal to 100.

The first spraying was carried out by spraying the powder formed of particles (a) of Comparative Example 1 over the surface using a DUP suction blast machine with the following parameters:

diameter of the nozzle: 8 mm, pressure: 2 bar, spraying distance: 15 cm, spraying angle: 85°, degree of coverage: 100%.

Then, the second spraying was carried out by spraying, over the surface obtained after the first spraying, the powder formed of notching particles (g), the second spraying being carried out using a DUP suction blast machine under the following conditions:

diameter of the nozzle: 8 mm, pressure: 2 bar, spraying distance: 15 cm, spraying angle: 85°, degree of coverage: 100%.

The gloss G is measured using a Multi Gloss 268Plus device from Konica Minolta ith an angle equal to 60°.

The lightness L is measured with a Mini Scan XE Plus of the HunterLab brand according to Standard ASTM E308-01 "Standard practice for computing the colors of objects by using the CIE system".

The impact strength of each group of particles (a) to (e) is estimated using the following test: 100 g of particles are sprayed by means of the said blast machine onto a surface made of stainless steel for 5 minutes with a spraying angle, with respect to the surface, equal to 90°, a spraying distance equal to 10 cm, a pressure equal to 2 bar and a diameter of the nozzle equal to 8 mm.

Before the test, the weight $W_1$ of the particles passing through the meshwork of a 45 μm sieve is determined. The threshold of 45 μm is well suited to demonstrating an enrichment in fine particles for the groups of particles tested.

The test particles subsequently undergo recirculation for 5 min and are thus sprayed several times onto the surface.

After the test, the weight $W_2$ of the particles passing through the meshwork of a 45 μm sieve is determined. The difference between the weights $W_1$ and $W_2$ corresponds to the amount of fine particles created during the test. This amount of fine particles generated, or "reject rate", is expressed as percentage of the weight of particles before the test. The higher the reject rate, the lower the impact strength of the particles.

It is considered that a reject rate of greater than 25% results in accelerated wear of the blast machine. Preferably, the reject rate is less than 20%, preferably less than 15%, preferably less than 10%.

The Almen intensity is determined according to Standard NF L06-832 (Grenaillage conventionnel destiné à la mise en contrainte de compression superficielle de pièces métalliques [Conventional shot blasting machine intended to place metal parts under surface compressive stress]), on a test specimen of N type, on a DUP suction blast machine, with a degree of coverage equal to 100%, with a spraying angle, with respect to the surface, equal to 85°, a spraying distance equal to 15 cm, a pressure equal to 2 bar and a diameter of the nozzle equal to 8 mm.

For the sake of simplicity, the circularity squared, the area and the dimension of the particles and also the mean circularity squared, the total area and the mean dimension of the groups of particles (a) to (g) are evaluated on the source powders of the said particles, in other words on the group of particles (a), on the powder formed of Zirgrit® F grains, on the powder formed of silicon carbide grains and on the powder formed of abrasive alumina/zirconia grains, by the following method:

11 mm$^3$ of a sample of particles are poured into the dispersion unit ("Sample dispersion unit") provided for this purpose of a Morphologi® G3S device sold by Malvern. The dispersing of the sample over the glass plate is carried out using a pressure of 4 bar ("Pressure") applied for 10 ms ("Setting time"), the dispersion unit remaining on the glass plate ("Setting time") for 60 seconds. The magnification chosen is defined so as to be able to observe between 25 and 50 particles on the glass plate, in a region located in the centre of the disc of dispersed particles, so as to promote the observation of individual particles, that is to say particles which are not joined to other particles. An image analysis is subsequently carried out of the photographs produced, in a sufficient number so as to count a total number of particles of greater than 250.

The device provides an evaluation of the circularity squared ("HS circularity") of the area ("Area") and of the dimension ("CE diameter") of the particles counted, the said particles being counted by number. The mean circularities squared, total areas and mean dimensions of the groups of particles may then be calculated.

The notching particles were faceted particles.

The number of facets of the notching particles is evaluated by the following method: Photographs of the particles are taken using a scanning electron microscope, so as to have between 15 and 30 notching particles entirely visible per photograph. Photographs are taken so as to be able to count a minimum of 200 notching particles. The number of visible facets of each notching particle is determined. The mean number of facets of the notching particles is the arithmetic mean of the number of facets of each notching particle.

The chemical analyses were carried out by X-ray fluorescence as regards the constituents for which the content is greater than 0.5%. The content of the constituents present in a content of less than 0.5% was determined by AES-ICP (Atomic Emission Spectroscopy-Inductively Coupled Plasma).

The size of the particles and also the median size and the maximum size of a group of particles were determined using a Partica LA-950 laser particle sizer from Horiba.

The results obtained appear in the following Table 1:

TABLE 1

| | | Example 1 Particles (a) | Example 2 Particles (b) | Example 3 Particles (c) | Example 4 Particles (d) | Example 5 Particles (e) | Example 6 Particles (f) | Example 7 - first spraying Particles (a) | Example 7 - second spraying Particles (g) |
|---|---|---|---|---|---|---|---|---|---|
| % by volume of notching particles | | <1 | 10 | 50 | 75 | 50 | 85 | <1 | >99 |
| Median size of the group of the sprayed particles (μm) | | 74 | 72 | 61 | 56 | 72 | 51 | 74 | 106 |
| Maximum size of the group of the sprayed particles (μm) | | 92 | 170 | 170 | 170 | 133 | 170 | 90 | 225 |
| Relative density of the sprayed particles (%) | | 98 | 98 | 98 | 98 | 99 | 98 | 98 | 99 |
| Mean dimension of the notching particles (μm) | | n.d. | 41 | 41 | 41 | 68 | 41 | n.d. | 102 |
| Mean dimension of the non-notching particles (μm) | | 65 | 65 | 65 | 65 | 65 | 65 | 65 | n.d. |
| Ratio of the mean dimension of the notching particles to the mean dimension of the non-notching particles | | n.d. | 0.63 | 0.63 | 0.63 | 1.05 | 0.63 | n.d. | n.d. |
| Mean circularity squared of the group of the notching particles | | n.d. | 0.83 | 0.83 | 0.83 | 0.75 | 0.83 | n.d. | 0.73 |
| Mean circularity squared of the group of the non-notching particles | | 0.97 | 0.97 | 0.97 | 0.97 | 0.97 | 0.97 | 0.97 | n.d. |
| Mean number of facets of the notching particles | | n.d. | 7 | 7 | 7 | 5 | 7 | n.d. | 5 |
| | Initial surface | | | | | | | | |
| Gloss G | 100 | 20 | 12 | 4 | 2 | 5 | 2 | 20 | 2 |
| Lightness L | 70 | 86 | 73 | 58 | 57 | 66 | 53 | 86 | 73 |
| Almen intensity FN (in hundredths of a mm) | — | 8.8 | 8.1 | 7.4 | 5.5 | 4.7 | 5 | 8.8 | 8.8 |
| Reject rate (%) | — | 5 | 7 | 16 | 23 | 17 | 27 | 5 | 30 |

n.d.: not determined

Comparative Example 1 results in a darkening and in a reduction in the gloss, that is to say in a dark and matt rendering.

In comparison with Example 1, Example 2 according to the invention results in a reduction in the gloss and also in a reduction in the lightness, with a low reject rate and a reduction in the Almen intensity. The efficiency (high powder consumption) and the productivity (frequent shutdowns of the blast machine in order to replace the powder) are thus low.

In comparison with Examples 1 and 2, Example 3 according to the invention results in a reduction in the gloss and also in a reduction in the lightness and in the Almen intensity, with a moderate reject rate, without accelerated wear of the blast machine.

In comparison with Examples 1 to 3, Example 4 according to the invention results in a reduction in the gloss and also in a reduction in the lightness and in the Almen intensity, with an acceptable reject rate and without accelerated wear of the blast machine.

In comparison with Example 1, Example 5 according to the invention results in a reduction in the gloss and also in a reduction in the Almen intensity, with a moderate reject rate, without accelerated wear of the blast machine. Example 5 according to the invention illustrates the possibility of using notching particles which are not in the form of oxide(s), such as silicon carbide particles.

Example 6, which is outside the invention, shows that the desired compromise is not achieved with a mixture comprising 85% by volume of notching particles: the reject rate is too high, which brings about accelerated wear of the blast machine.

Example 7, which is outside the invention, shows that a first spraying of the powder formed of beads (a), followed by a second spraying of the powder formed of notching particles (g), does not make it possible to achieve the desired compromise: while the gloss is indeed reduced, the Almen intensity and the reject rate obtained after the second spraying are too high. It is thus important to spray a group of notching particles and of non-notching particles.

Figure 4:
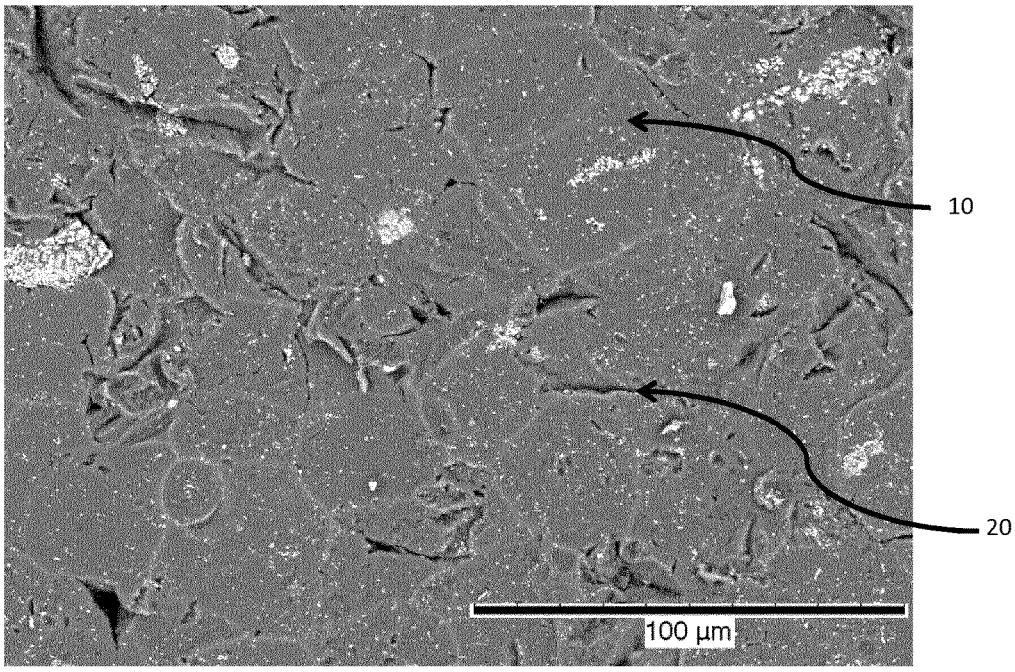

As represented in FIG. 4, a visual examination of the surface obtained after the treatment of Example 3 according to the invention shows that it is covered with cavities 10 in the form of scales corresponding to the impression resulting from the spraying of the beads (non-notching particles) and with notches 20 corresponding to the impression resulting from the spraying of the notching particles.

Figure 3:
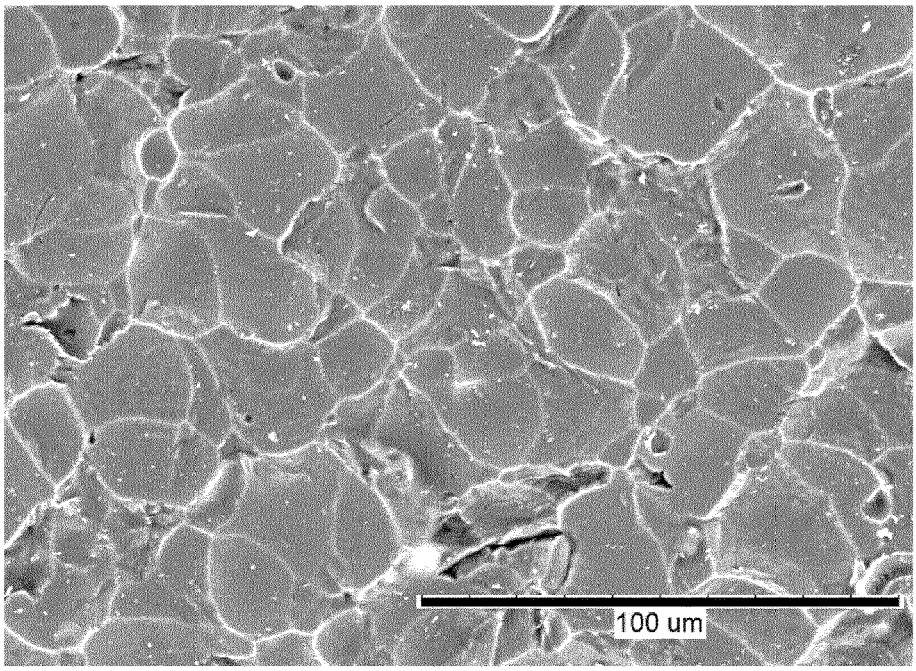
FIGS. 3 and 4 represent photographs of surfaces treated in a process conventionally using spherical beads in accordance with Comparative Example 1 and according to the process of Example 3 according to the invention, respectively.

The comparison with FIG. 3 makes it possible to clearly distinguish the presence of notches.

Of course, the invention is not limited to the embodiments described, which are provided by way of illustration and without implied limitation.

The invention claimed is:

1. Process for modifying the appearance of a surface, the said process comprising a stage of spraying particles exhibiting a maximum size of less than or equal to 500 μm, said particles exhibiting a maximum size of less than or equal to 500 μm being referred to as "sprayed particles", the sprayed particles exhibiting a relative density of greater than 90%, more than 5% and less than 80% by volume of the said sprayed particles exhibiting a salient sharp edge, said sprayed particles exhibiting a salient sharp edge being referred to as "notching particles", said sprayed particles not exhibiting a salient sharp edge being referred to as "non-notching particles".

2. Process according to claim 1, in which the group of the sprayed particles comprises more than 20% and less than 60%, by volume, of notching particles.

3. Process according to claim 1, in which the group of the sprayed particles exhibits a maximum size of less than 400 μm and exhibits a minimum size of greater than 15 μm.

4. Process according to claim 3, in which the group of the sprayed particles exhibits a maximum size of less than 200 μm and a minimum size of greater than 30 μm.

5. Process according to claim 4, in which the group of the sprayed particles exhibits a maximum size of less than 150 μm.

6. Process according to claim 1, in which the ratio of a mean dimension of the notching particles to a mean dimension of the non-notching particles is less than 3.

7. Process according to claim 1, in which the sprayed particles exhibit a relative density of greater than 96%.

8. Process according to claim 1, in which the group of the notching particles exhibits a mean circularity squared of less than 0.9 and the group of the non-notching particles exhibits a mean circularity squared of greater than 0.7.

9. Process according to claim 1, in which the mean number of facets of the notching particles is greater than 3 and less than 30.

10. Process according to claim 9, in which the mean number of facets of the notching particles is less than 15.

11. Process according to claim 1, in which the sprayed particles are made of a ceramic material.

12. Process according to claim 11, in which the sprayed particles are made of a ceramic material, chosen from oxides, nitrides, carbides, borides, oxycarbides, oxynitrides and mixtures of oxides, nitrides, carbides, borides, oxycarbides, and oxynitrides.

13. Process according to claim 12, in which the group of the notching particles exhibits a composition such that $Al_2O_3+ZrO_2+SiO_2>80\%$, as percentage by weight on the basis of the oxides.

14. Process according to claim 12, in which the group of the non-notching particles exhibits a composition such that $Al_2O_3+ZrO_2+SiO_2>80\%$, as percentage by weight on the basis of the oxides.

15. Process according to claim 12, in which the sprayed particles are composed, for more than 80% of their weight, of silicon carbide.

16. Process according to claim 12, in which the group of the notching particles is composed, for more than 80% of its weight, of silicon carbide.

17. Process according to claim 12, in which the group of the non-notching particles is composed, for more than 80% of its weight, of silicon carbide.

18. Process according to claim 12, in which the sprayed particles exhibit a composition such that $Al_2O_3+ZrO_2+SiO_2>80\%$, as percentage by weight on the basis of the oxides.

19. Process according to claim 18, in which the sprayed particles:

exhibit a composition such that, as percentage by weight on the basis of the oxides:

$70\%\leq Al_2O_3$, $Al_2O_3$ constituting the remainder to 100%, $3\%\leq ZrO_2+HfO_2\leq 20\%$, with $HfO_2\leq 1\%$, $1\%\leq SiO_2\leq 10\%$, $0.3\%\leq CaO+MgO\leq 5\%$, other constituents <5%.

20. Process according to claim 18, in which the sprayed particles exhibit a composition such that, as percentage by weight on the basis of the oxides:

$Al_2O_3\leq 10\%$, $60\%\leq ZrO_2+HfO_2\leq 70\%$, with $HfO_2\leq 1\%$, $25\%\leq SiO_2\leq 35\%$, other constituents <5%.

21. Process according to claim 18, in which the sprayed particles exhibit a composition such that, as percentage by weight on the basis of the oxides:

$Al_2O_3\leq 10\%$, $65\%\leq ZrO_2+HfO_2\leq 80\%$, with $HfO_2\leq 1.5\%$, $10\%\leq SiO_2\leq 20\%$, $4\%\leq Y_2O_3\leq 8\%$, other constituents <3%.

22. Process according to claim 18, in which the sprayed particles exhibit a composition such that, as percentage by weight on the basis of the oxides:

$90\%\leq Al_2O_3$, other constituents <10%.

23. Process according to claim 18, in which the sprayed particles are composed, for more than 80% of their weight, of zirconia which is at least partially stabilized, preferably at least partially stabilized with yttrium oxide.

24. Process according to claim 18, in which the sprayed particles exhibit a composition such that, as percentage by weight on the basis of the oxides:

$70\%\leq Al_2O_3\leq 80\%$, $20\%\leq ZrO_2+HfO_2\leq 30\%$, with $HfO_2\leq 1\%$, other constituents ≤3%.

25. Process according to claim 18, in which the group of the notching particles exhibits a composition such that, as percentage by weight on the basis of the oxides:

$70\% \leq Al_2O_3$, $Al_2O_3$ constituting the remainder to 100%,
$3\% \leq ZrO_2+HfO_2 \leq 20\%$, with $HfO_2 \leq 1\%$,
$1\% \leq SiO_2 \leq 10\%$,
$0.3\% \leq CaO+MgO \leq 5\%$,
other constituents <5%.

26. Process according to claim 18, in which the group of the notching particles exhibits a composition such that, as percentage by weight on the basis of the oxides:
$Al_2O_3 \leq 10\%$,
$60\% \leq ZrO_2+HfO_2 \leq 70\%$, with $HfO_2 \leq 1\%$,
$25\% \leq SiO_2 \leq 35\%$,
other constituents <5%.

27. Process according to claim 18, in which the group of the notching particles exhibits a composition such that, as percentage by weight on the basis of the oxides:
$Al_2O_3 \leq 10\%$,
$65\% \leq ZrO_2+HfO_2 \leq 80\%$, with $HfO_2 \leq 1.5\%$,
$10\% \leq SiO_2 \leq 20\%$,
$4\% \leq Y_2O_3 \leq 8\%$,
other constituents <3%.

28. Process according to claim 18, in which the group of the notching particles exhibits a composition such that, as percentage by weight on the basis of the oxides:
$90\% \leq Al_2O_3$,
other constituents <10%.

29. Process according to claim 18, in which the group of the notching particles is composed, for more than 80% of its weight, of zirconia which is at least partially stabilized.

30. Process according to claim 18, in which the group of the notching particles exhibits a composition such that, as percentage by weight on the basis of the oxides:
$70\% \leq Al_2O_3 \leq 80\%$,
$20\% \leq ZrO_2+HfO_2 \leq 30\%$, with $HfO_2 \leq 1\%$,
other constituents ≤3%.

31. Process according to claim 18, in which the group of the non-notching particles exhibits a composition such that, as percentage by weight on the basis of the oxides:
$70\% \leq Al_2O_3$, $Al_2O_3$ constituting the remainder to 100%,
$3\% \leq ZrO_2+HfO_2 \leq 20\%$, with $HfO_2 \leq 1\%$,
$1\% \leq SiO_2 \leq 10\%$,
$0.3\% \leq CaO+MgO \leq 5\%$,
other constituents <5%.

32. Process according to claim 18, in which the group of the non-notching particles exhibits a composition such that, as percentage by weight on the basis of the oxides:
$Al_2O_3 \leq 10\%$,
$60\% \leq ZrO_2+HfO_2 \leq 70\%$, with $HfO_2 \leq 1\%$,
$25\% \leq SiO_2 \leq 35\%$,
other constituents <5%.

33. Process according to claim 18, in which the group of the non-notching particles exhibits a composition such that, as percentage by weight on the basis of the oxides:
$Al_2O_3 \leq 10\%$,
$65\% \leq ZrO_2+HfO_2 \leq 80\%$, with $HfO_2 \leq 1.5\%$,
$10\% \leq SiO_2 \leq 20\%$,
$4\% \leq Y_2O_3 \leq 8\%$,
other constituents <3%.

34. Process according to claim 18, in which the group of the non-notching particles exhibits a composition such that, as percentage by weight on the basis of the oxides:
$90\% \leq Al_2O_3$,
other constituents <10%.

35. Process according to claim 18, in which the group of the non-notching particles is composed, for more than 80% of its weight, of zirconia which is at least partially stabilized.

36. Process according to claim 18, in which the group of the non-notching particles exhibits a composition such that, as percentage by weight on the basis of the oxides:
$70\% \leq Al_2O_3 \leq 80\%$,
$20\% \leq ZrO_2+HfO_2 \leq 30\%$, with $HfO_2 \leq 1\%$,
other constituents ≤3%.

37. Process according to claim 1, in which
the sprayed articles are sprayed on said surface along a direction forming a spraying angle with the surface, the spraying angle being greater than 45°.

38. Process according to claim 37, in which
the spraying angle is greater than 50°.

39. Process according to claim 37, in which the particles are sprayed by passing through a nozzle situated at a distance referred to as "spraying distance", from the treated surface, the said spraying distance is greater than 10 cm and less than 25 cm.

40. Process according to claim 37, in which the particles are sprayed onto the surface by being carried by a fluid, the pressure of which is greater than 1 bar and less than 3 bar.

41. Process according to claim 37, in which the particles are sprayed with a degree of coverage of greater than 150% and of less than 250%.

42. Process according to claim 1, in which the surface is made of a metal material, the surface being devoid of a coating.

43. Process according to claim 1, in which the notching particles are mixed with the non-notching particles before being sprayed.

44. Process according to claim 1, in which, before the stage of spraying particles, the surface is polished so that its roughness Ra is less than or equal to 1 μm.

45. Process according to claim 1, in which the surface is a surface of a product selected from the group formed by a jewel, a watch, a bracelet, a necklace, a ring, a broach, a tiepin, a handbag, a piece of furniture, a household utensil, a handle, a button, a veneer, a visible part of a consumer goods device, a part of a spectacle frame, a piece of crockery or a frame.

46. Process according to claim 1, in which the particles are sprayed by passing through a nozzle situated at a distance, referred to as "spraying distance", from the treated surface, the said spraying distance being greater than 5 cm and less than 30 cm.

47. Process according to claim 1, in which the particles are sprayed onto the surface by being carried by a fluid, the pressure of which is greater than 0.5 bar and less than 4 bar.

48. Process according to claim 1, in which the particles are sprayed with a degree of coverage of greater than 100% and with a degree of coverage of less than 300%.

49. Process according to claim 1, in which the surface is made of stainless steel, of aluminium or of titanium, the surface being devoid of a coating.

* * * * *